US006148758A

United States Patent [19]

Wilkins

[11] Patent Number: 6,148,758

[45] Date of Patent: Nov. 21, 2000

[54] BOAT ANCHOR

[75] Inventor: Larry C. Wilkins, Georgetown, Ind.

[73] Assignee: Electromechanical Research Laboratories, Inc., New Albany, Ind.

[21] Appl. No.: 09/273,035

[22] Filed: Mar. 19, 1999

Related U.S. Application Data

[63] Continuation-in-part of application No. 09/018,289, Feb. 4, 1998, abandoned.

[51] Int. Cl.[7] ..... B63B 21/32

[52] U.S. Cl. ..... 114/301; 114/304

[58] Field of Search ..... 114/294, 301–306, 114/309; D12/25

[56] References Cited

U.S. PATENT DOCUMENTS

| | | | |
|---|---|---|---|
| 2,511,286 | 6/1950 | Millen | 114/298 |
| 2,847,963 | 8/1958 | Knitter | 114/298 |
| 4,602,588 | 7/1986 | MacLean . | |
| 4,655,158 | 4/1987 | Holder | 114/304 |
| 5,133,277 | 7/1992 | Peabody | 114/294 |
| 5,138,967 | 8/1992 | McCaron et al. | 114/301 |
| 5,188,055 | 2/1993 | Kershner | 114/301 |
| 5,353,732 | 10/1994 | Gramet et al. | 114/304 |

OTHER PUBLICATIONS

Catalog entitled "West Marine We make boating more fun!™" 1997 Sailboat Master Catalog, pp. 145–151.

*Primary Examiner*—Ed Swinehart
*Attorney, Agent, or Firm*—Woodard, Emhardt, Naughton, Moriarty & McNett

[57] ABSTRACT

An anchor for a marine vessel has a shank pivotally connected to a fluke allowing pivotal movement therebetween about a pivot axis within a range of motion. The anchor also has a pivot control member engageable between the shank and the fluke to regulate the pivotal movement throughout at least a portion of the range of motion. The pivot control member is elastically deformed as the shank is pivoted relative to the fluke. The anchor has an operational position in which the point of connection of an anchor line to the shank is positioned below a horizontal plane containing the pivot axis.

42 Claims, 17 Drawing Sheets

BOAT ANCHOR

This application is a continuation-in-part application of Ser. No. 09/018,289, filed on Feb. 4, 1998, now abandoned.

BACKGROUND OF THE INVENTION

This invention relates generally to an anchor for a marine vessel, and more particularly to a plow-type boat anchor. Anchors of the plow type are available in a weight range typically between ten and one hundred pounds. While many different types of boat anchors have been developed and used, the plow-type is often selected because of its compatibility with various underwater bottom materials including, for example, sand, weeds, rocks, and mud. Examples of conventional plow-type anchors are C.Q.R.™ Anchors and Delta Fast-Set Anchors by Simpson Lawrence, Ltd., and the Plough Anchors by Sascot.

Conventional plow-type anchors are typically made of forged or cast steel, resulting in a relatively expensive product. In addition, it has been found that, in some instances, these anchors will simply turn the sand as in plowing a field rather than digging in and holding a boat. Also, it sometimes happens that, when the anchor line begins to pull on the anchor, it will pull up the point of the anchor, thus disabling it from digging in and holding to the bottom.

Moreover, conventionally designed plow-type anchors typically have a relatively high center of gravity and tend to tip sideways before they can be adequately imbedded in the bottom, thus making them difficult to properly set. In many instances, the anchor line connecting the anchor to the boat is a chain. Consequently, the weight of the chain provides a downward force which has a tendency to tip the anchor on its side. Moreover, the shanks of conventional plow-type anchors are either aligned in a substantially horizontal configuration or are angled upwardly away from the bottom. Thus, the weight of the chain pulling downwardly on the shank is significant, and an anchor having a relatively high center of gravity is easily turned on its side. Once on its side, optimal setting of a conventional anchor is difficult, if not impossible, to achieve.

SUMMARY OF THE INVENTION

The present invention relates generally to an improved boat anchor. While the actual nature of the invention covered herein can only be determined with reference to the claims appended hereto, certain forms of the invention that are characteristic of the preferred embodiments disclosed herein are described briefly as follows.

According to a typical embodiment of the present invention, an anchor for a marine vessel includes a fluke portion pivotally connected to a shank portion to allow pivotal movement therebetween about a pivot axis within a range of motion. The anchor also includes a pivot control member which is engageable between the fluke portion and the shank portion to regulate the pivotal movement throughout at least a portion of the range of motion. In a further aspect of the invention, the pivot axis is preferably contained in a horizontal plane. The shank portion is connected to an anchor line at a locus of connection, and the anchor has an operational position in which the locus of connection is placed below the horizontal plane. In another aspect of the invention, the pivot control member is elastically deformed to provide regulation of the pivotal movement throughout at least a portion of the range of motion between the shank portion and the fluke portion. Preferably, the pivot control member is composed of an elastomeric material, such as urethane.

DESCRIPTION OF THE PREFERRED EMBODIMENTS

Figure 1:
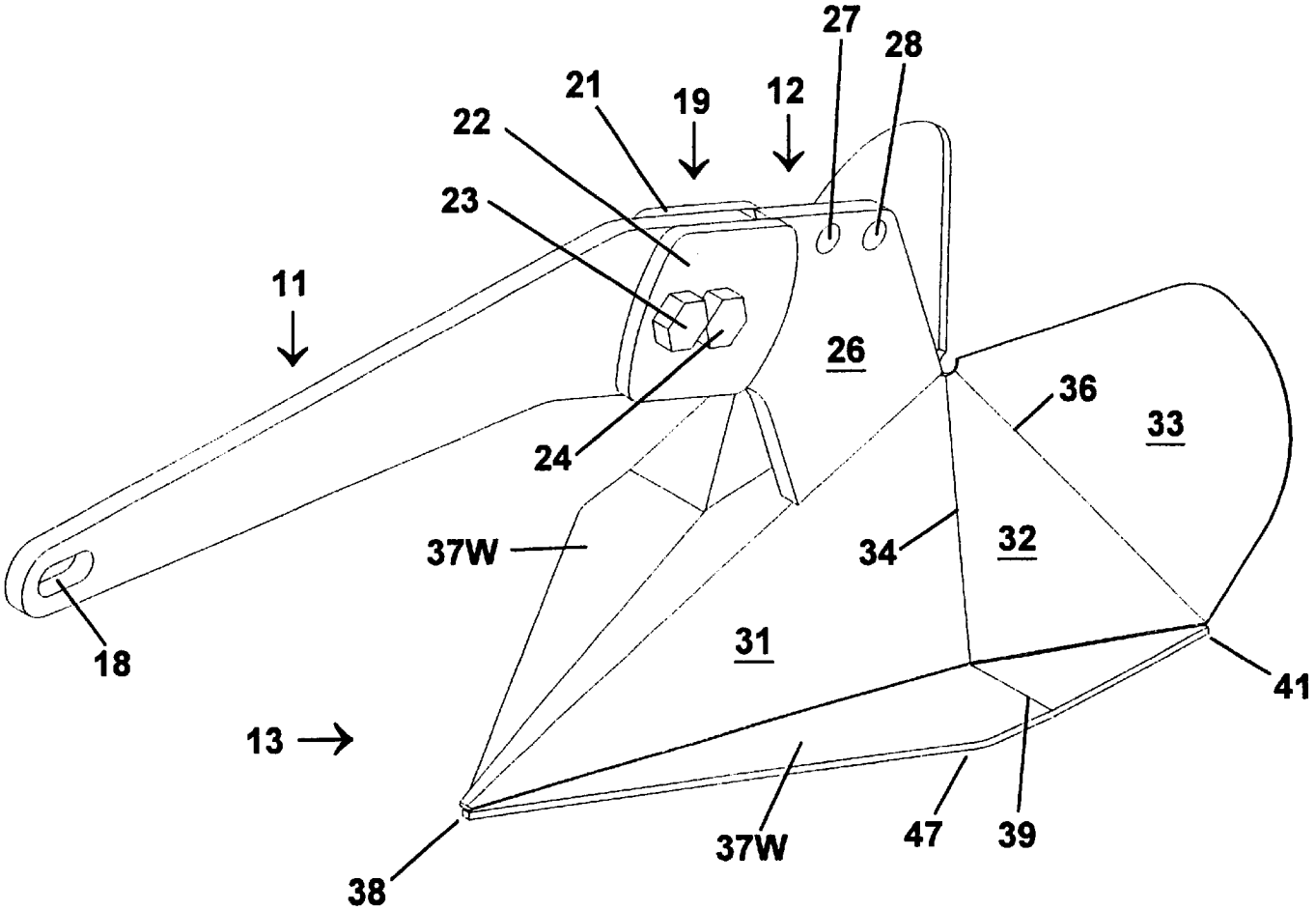
FIG. 1 is a perspective view of a boat anchor according to a typical embodiment of the present invention.
Figure 2:
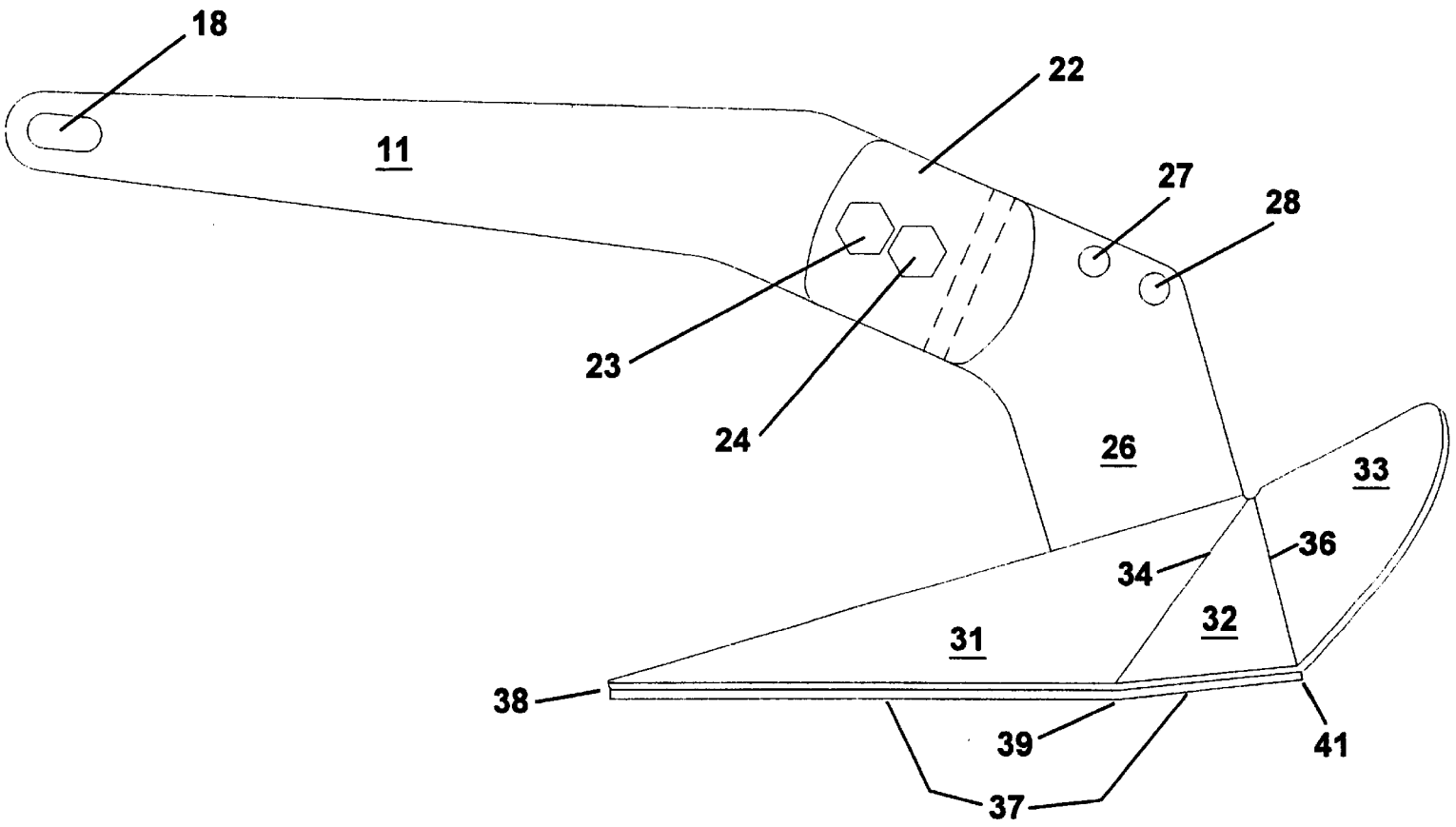
FIG. 2 is a side elevational view of the anchor shown in FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations and further modifications in the illustrated device, and any further applications of the principles of the invention as illustrated therein being contemplated as would normally occur to one skilled in the art to which the invention relates.

Figure 8:
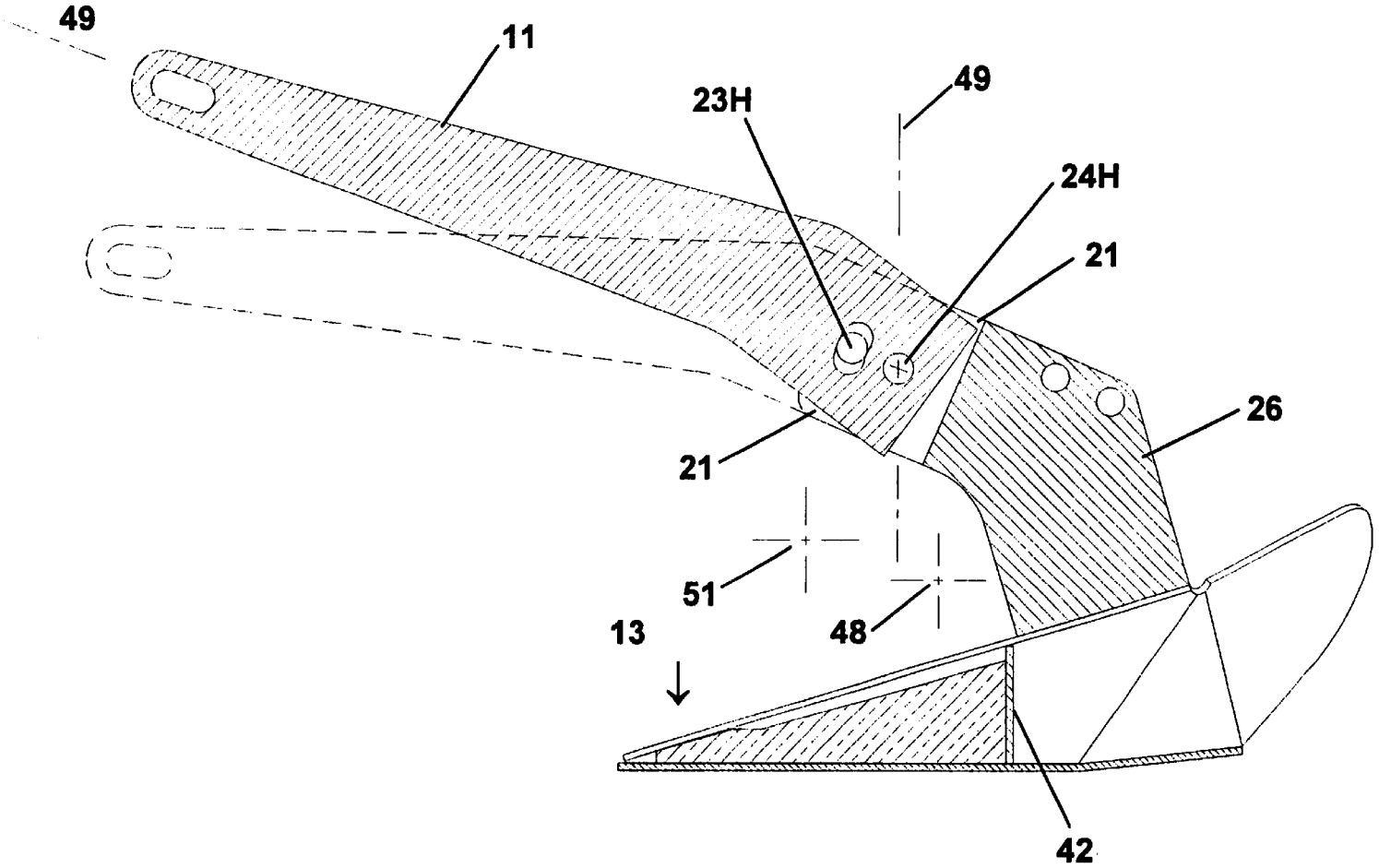
FIG. 8 is sectional view of the anchor shown in FIG. 1, illustrating a second operational position of the anchor with the shank tilted upward.
Figure 9:
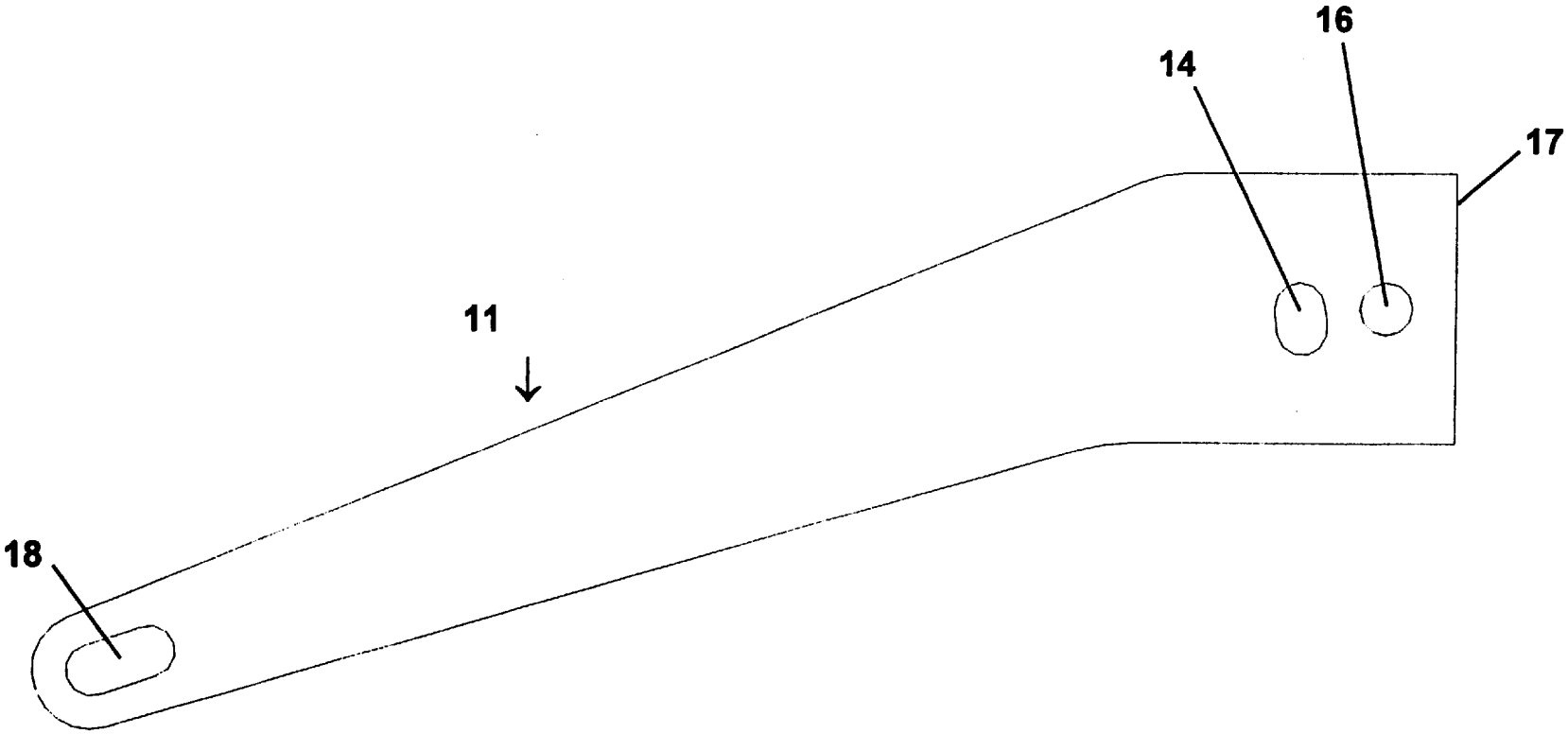
FIG. 9 is an enlarged side elevation view of a shank used with the anchor shown in FIG. 1.
Figure 10:
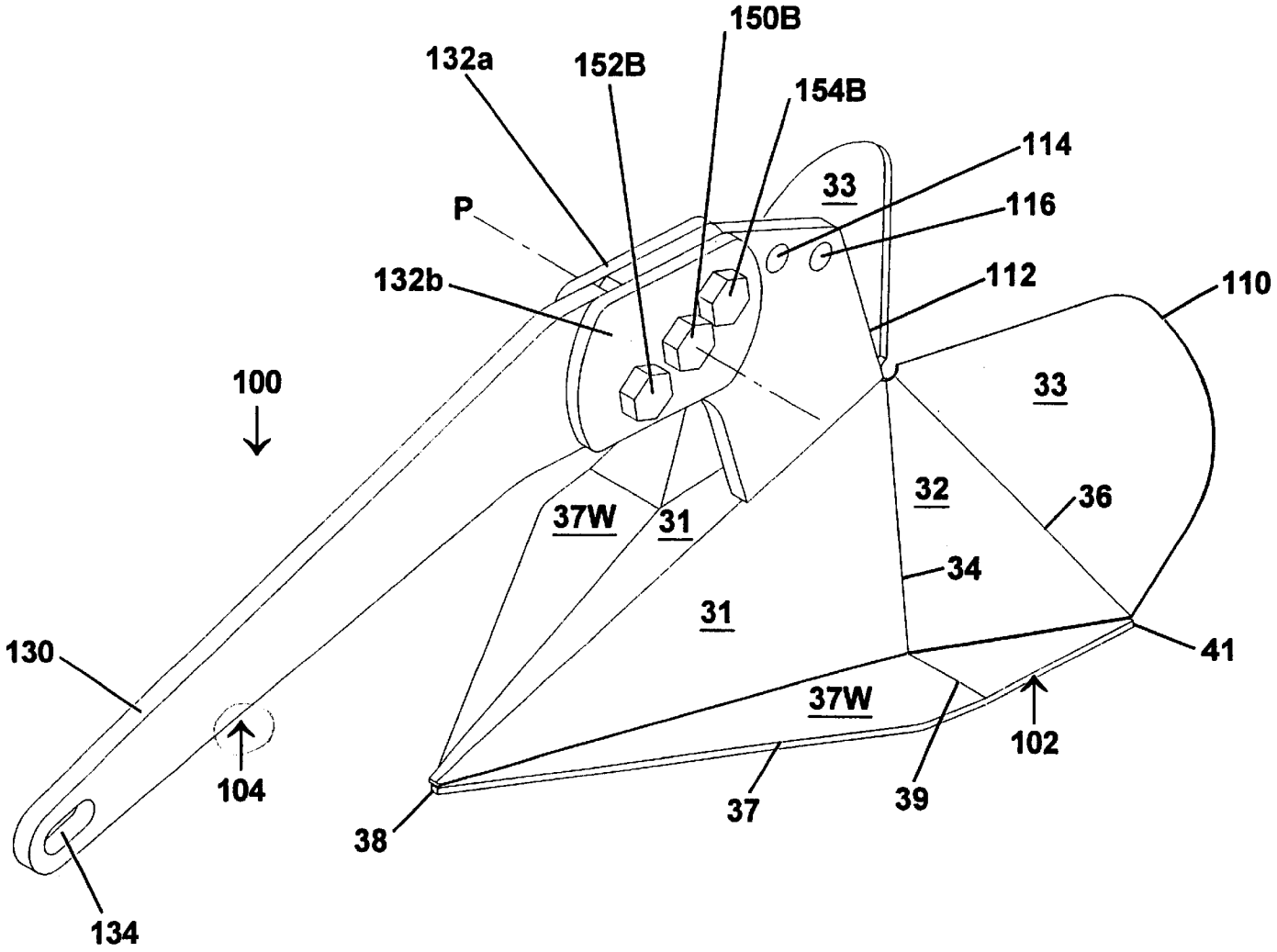
FIG. 10 is a perspective view of a boat anchor according to another embodiment of the present invention.
Figure 11:
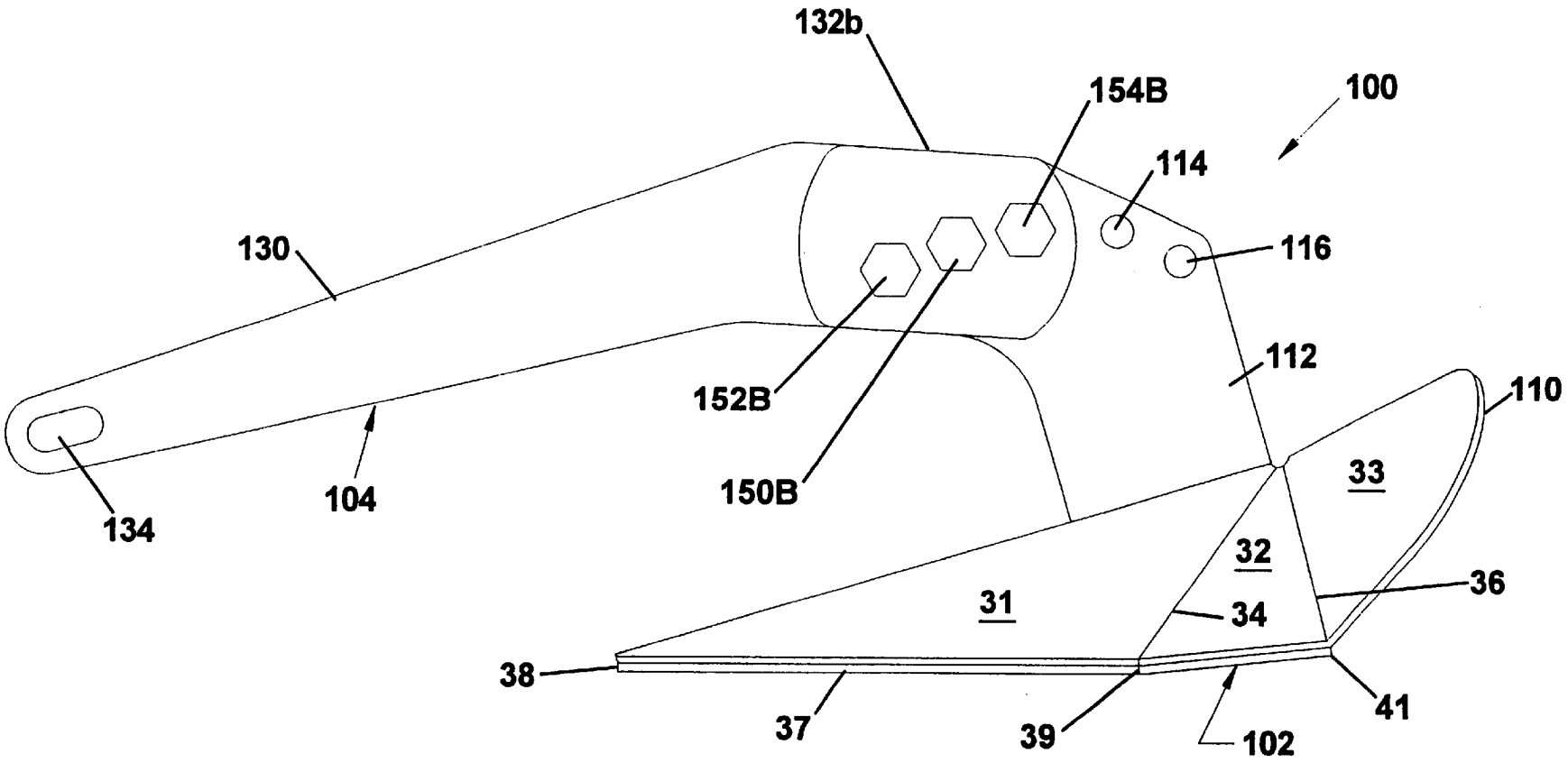
FIG. 11 is a side elevational view of the anchor shown in FIG. 10.

Referring now to the drawings in detail, the anchor has a shank 11, arm 12, and fluke 13. In a preferred embodiment, all of these portions are fabricated from polished stainless steel plate. The shank shown in FIG. 9 has two holes 14 and 16 adjacent the end 17 proximal to the arm 12, and a rope or chain receiver hole 18 adjacent the distal end. A yoke 19 comprises two parallel yoke plates 21 and 22 welded to opposite sides of the arm 12. The plate 22 has two round holes (not shown) receiving therethrough the bolts 23 and 24 which pass through two round holes 23H and 24H in plate 21 and are screwed into lock nuts 23*n* and 24*n* on the far side of plate 21. Bolt 24 is received through the round hole 16 in the shank and serves as a pivot. Bolt 23 is received through the elongate hole 14 in the shank and serves to limit the pivoting of the shank relative to the arm to an arc of between 10 and 25 degrees. This pivoting feature is illustrated in FIG. 8.

The arm 26 is welded to the fluke and has two holes 27 and 28 in it. The hole 28 serves as an eye for attachment of a trip line to pull the anchor backward for easy break-out of the anchor when weighing anchor. The hole 27 is for pinning the anchor to a bow roller bracket on the boat for storage of the anchor when not in use.

Figure 3:
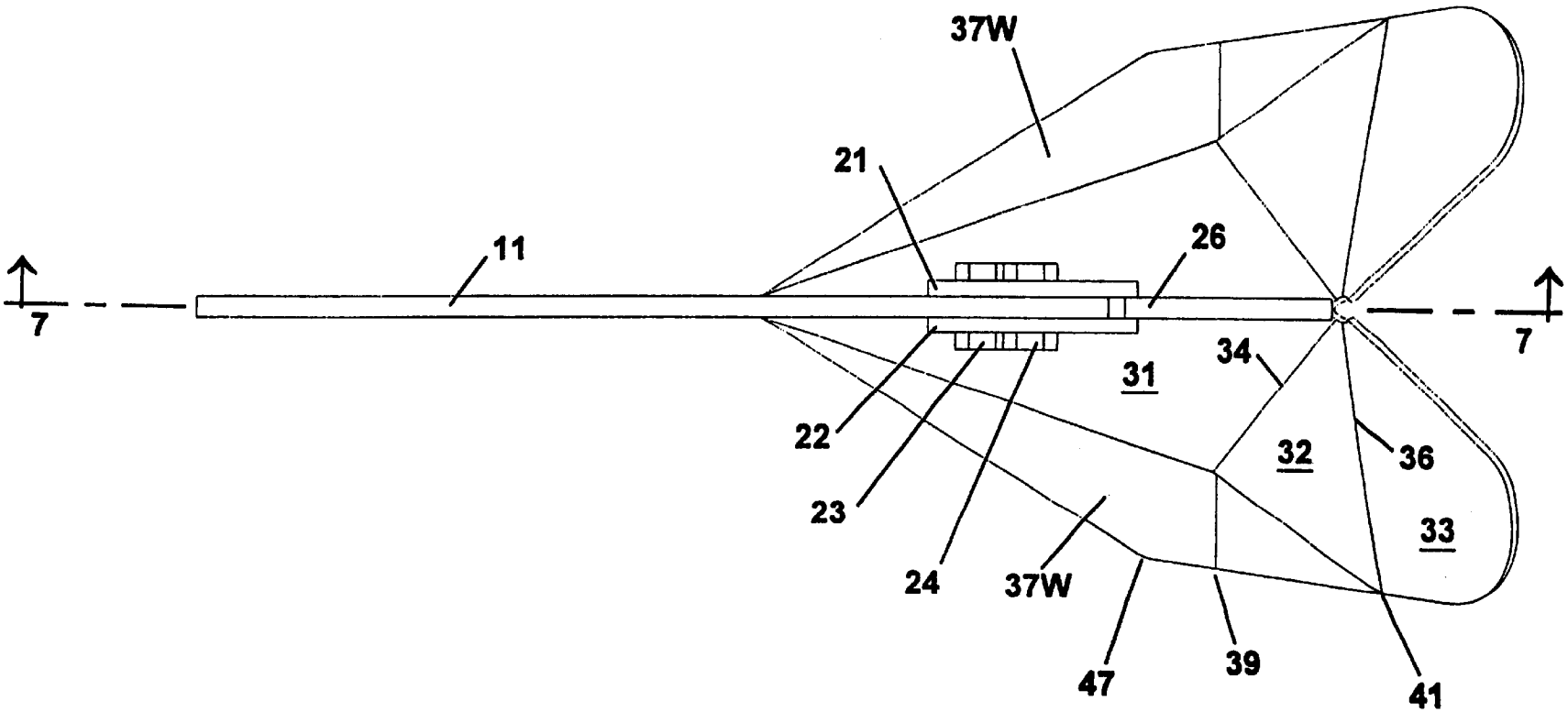
FIG. 3 is a top plan view of the anchor shown in FIG. 1.
Figure 4:
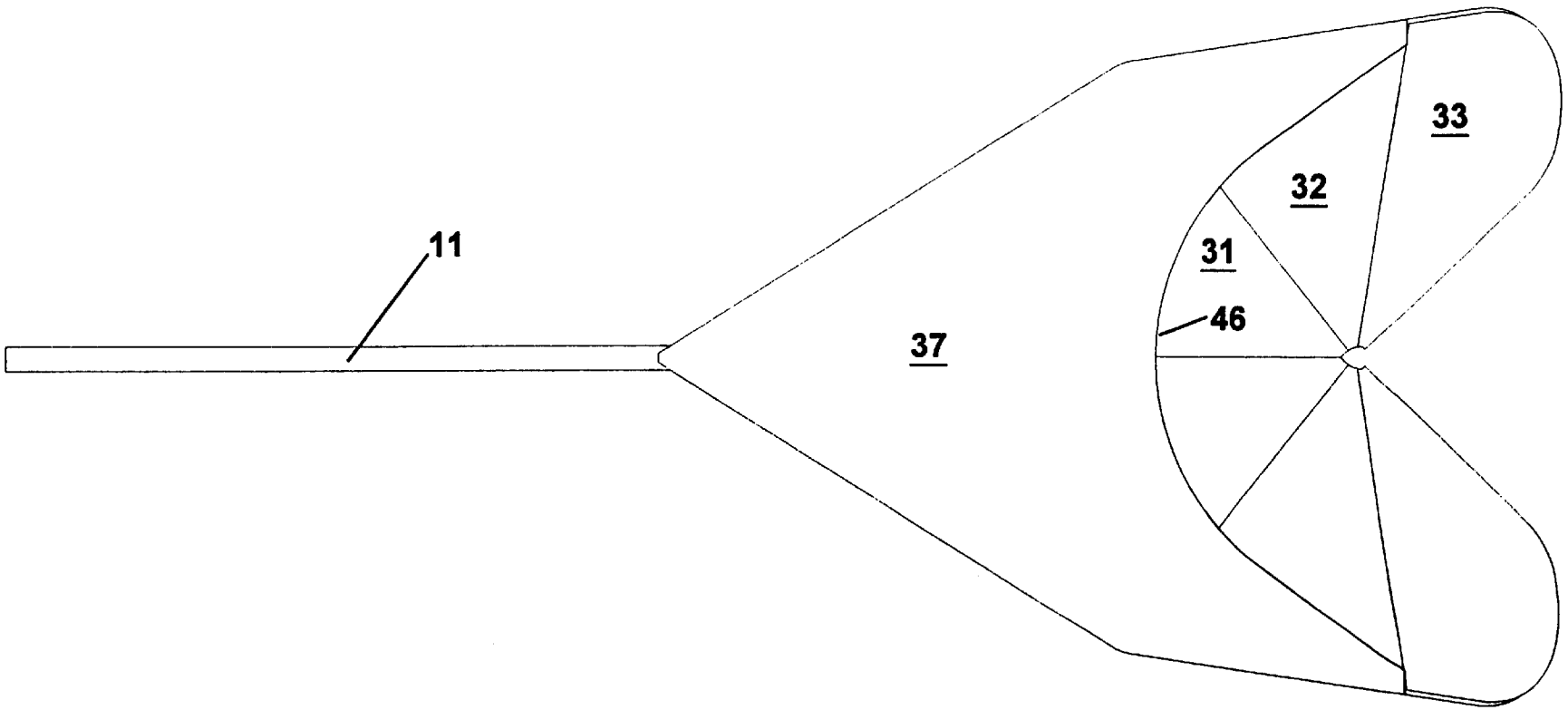
FIG. 4 is a bottom plan view of the anchor shown in FIG. 1.
Figure 5:
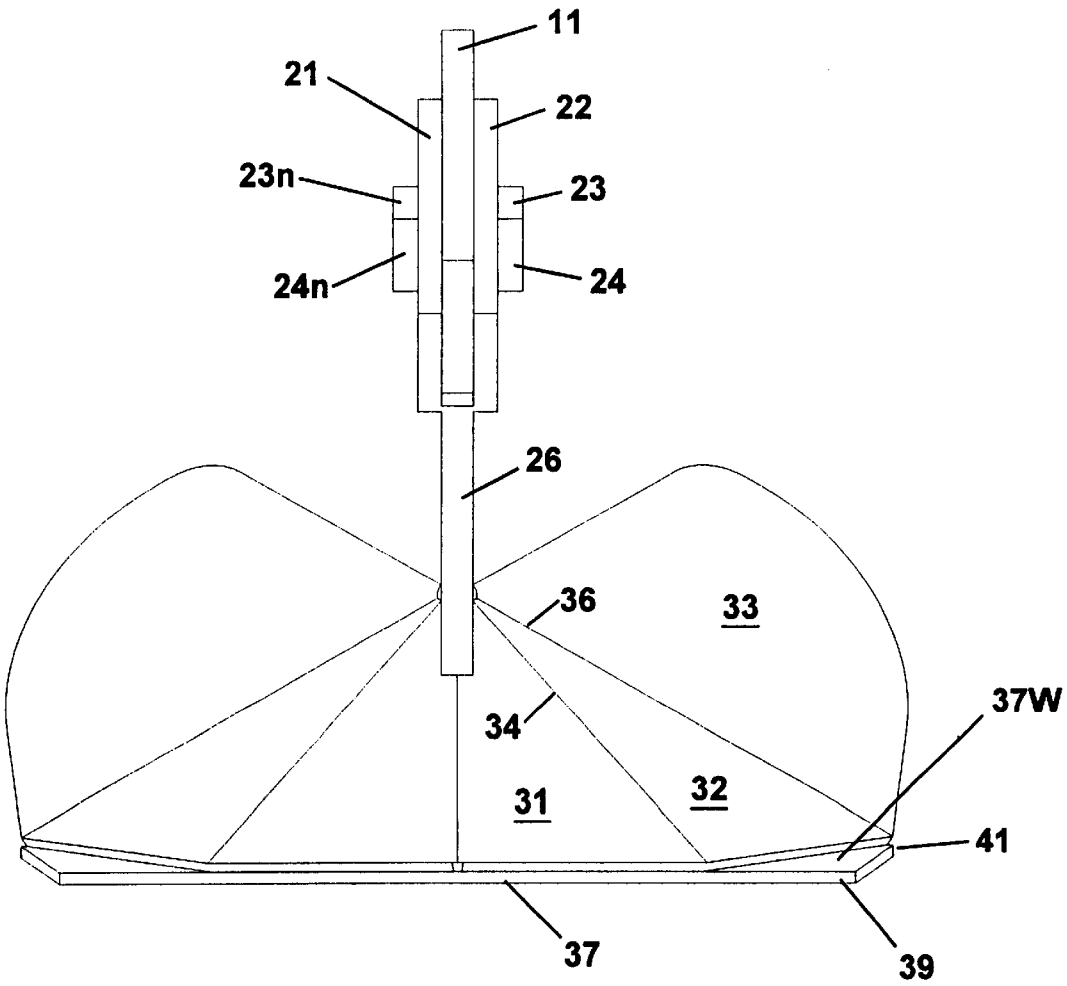
FIG. 5 is a front elevational view of the anchor shown in FIG. 1.
Figure 6:
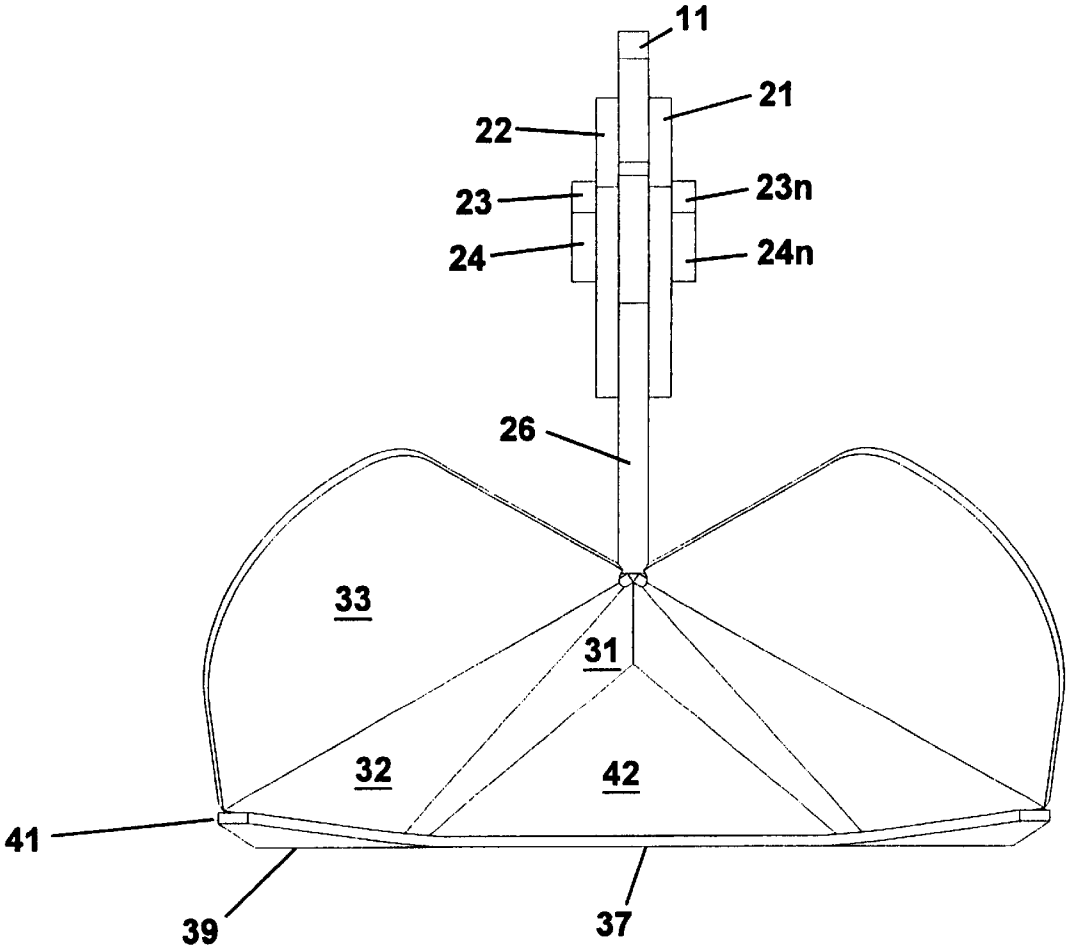
FIG. 6 is a rear elevational view of the anchor shown in FIG. 1.
Figure 7:
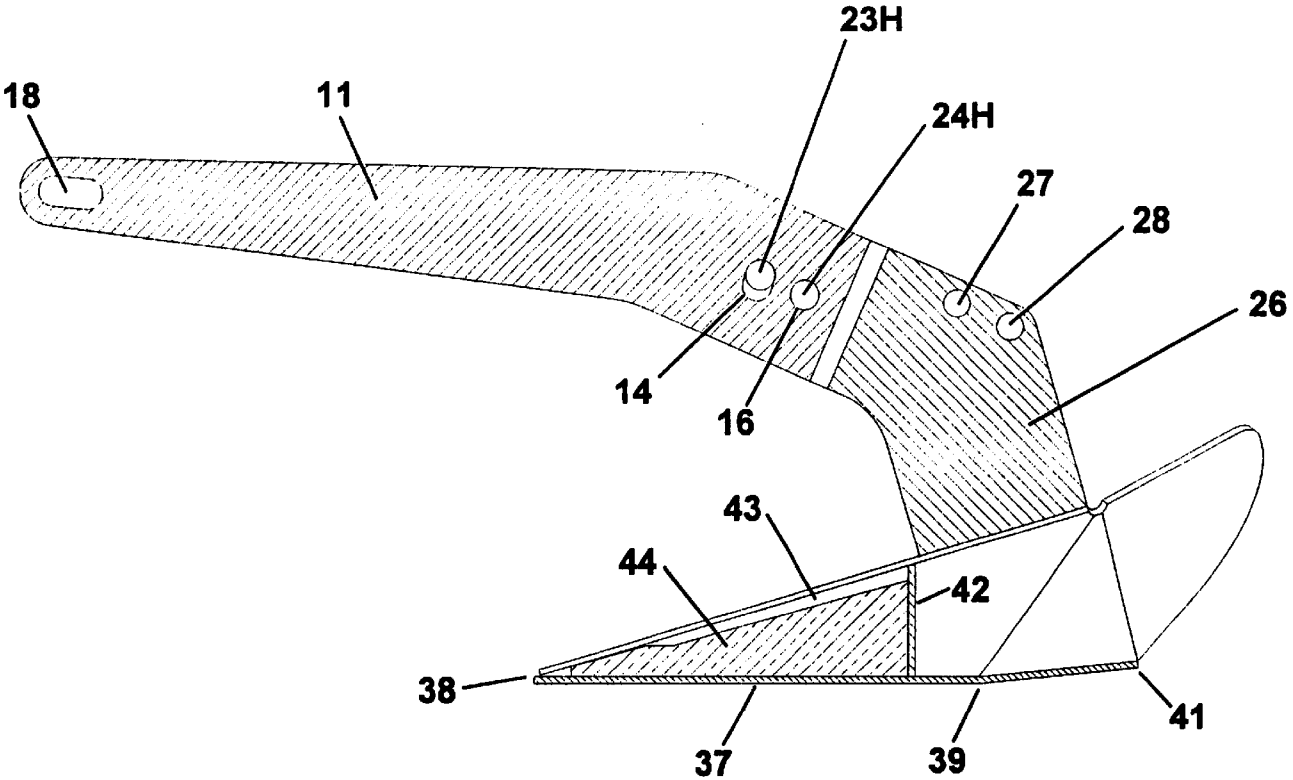
FIG. 7 is a sectional view of the anchor shown in FIG. 1 taken along line 7—7 of FIG. 3, illustrating a first operational position of the anchor.

The fluke of the anchor is typically symmetrical with respect to a plane 7—7 in FIG. 3 and containing the shank 11 and arm 12. Therefore, in terms of the fabricated unit of plates, a description of the features at one side of the plane 7—7 will suffice for both. Triangular panels 31, 32 and irregular panel 33 may be formed of a single piece of plate material, bent at the lines 34 and 36. Alternatively, it can be a fabrication of three separate plates welded at lines 34 and 36. A bottom plate 37 extends from the point 38 of panel 31 outwardly and rearwardly from the point in a triangular configuration, as best shown in the bottom view of FIG. 4, and is bent upward slightly at the line 39 and has its outboard edge terminate at point 41, coincident with the lower end of panel 33. This bottom or sole plate 37 thereby closes part of the bottom of the fluke of the anchor. Plate 37 cooperates with panel 31 and the mirror image on the opposite side of the center plane 7—7 to form a cavity 43 in the front end of the fluke which extends rearward from the point or tip 38 of the front of the fluke. A ballast 44 of lead is cast into cavity 43. Cavity 43 is then closed at the rear by a panel 42 (FIGS. 6 and 7). The space behind wall 42 in the fluke is open, the lower rear edge thereof being defined by the curved rear edge 46 (FIG. 4) of the bottom panel 37.

The portion 37W of the bottom panel 37 extends outward from the lower edge of the panel 31 along with its counterpart on the opposite side of the center plane 7—7, thus providing "wings" to inhibit the fluke from simply plowing through the sea bottom material and to inhibit rolling of the anchor. Although the wings extend toward the rear, their widest point is at a location ahead of the rear wall of the ballast chamber. In view of this, and the fact that the rear of the fluke is open, the center of gravity 48 (FIG. 8) of the combination of the fluke and arm, aided by the ample ballast 44 is near or slightly behind the vertical plane 49 containing the pivot axis of bolt 24. Of course, the center of gravity 51 of the combination of the fluke and arm with the shank, located forward as it is, coupled with the pivoting of the shank on the horizontal axis of bolt 24, tends to facilitate the downward tipping of the fluke for the point to dig in, particularly if drift of the boat while the anchor is dropping tends to result in a shallow angle of the line of pull of the anchor rope down from horizontal before the anchor sets.

While the anchor shown in FIGS. 1–9 can be made of different materials, the preferred material at present is #316 stainless steel plate, 3/16 inch thick for the fluke, and 3/8 inch thick for the arm and shank.

In another embodiment of the present invention, a marine anchor 100 is provided as shown in FIGS. 10–13. In this embodiment, anchor 100 includes a fluke 102 pivotally connected to a shank 104, and a pivot control member 106 (FIG. 13) engageable between fluke 102 and shank 104 to regulate pivotal movement therebetween. Fluke 102 and shank 104 are preferably fabricated from polished stainless steel plate, and more preferably #316 stainless steel plate. However, it should be understood that fluke 102 and shank 104 can alternatively be formed of cold rolled steel, or another suitably rugged material. If cold rolled steel is utilized, the surfaces of the plate are preferably provided with a coating of zinc or a similar corrosion resistant material, such as plastic, to protect the anchor from the harsh environment typically associated with marine use.

Figure 14:
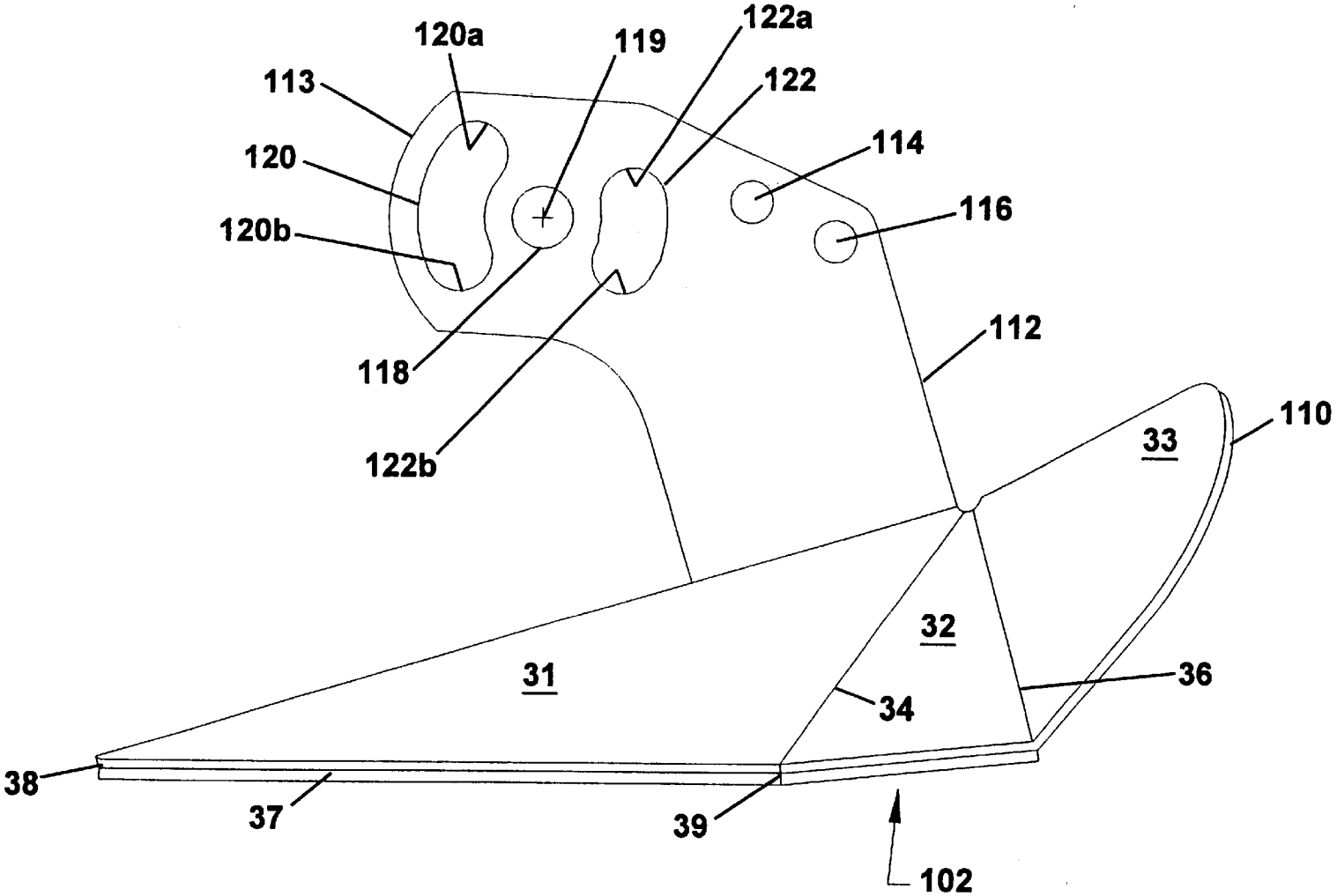
FIG. 14 is a side elevation view of a fluke used with the anchor shown in FIG. 10.

Referring to FIG. 14, shown therein are various structural details of fluke 102. Fluke 102 includes a blade portion 110 and a connection arm 112 extending from blade portion 110. Blade portion 110 is preferably formed of 3/16 inch thick stainless steel plate, while arm 112 is preferably formed of 3/8 inch thick stainless steel plate. Arm 112 is securely attached to blade portion 110, preferably by welding, to form an integral one-piece unit. However, it should be understood that fluke 102 need not necessarily include arm 112. For instance, shank 104 may be pivotally connected directly to blade portion 110.

Blade portion 110 is configured structurally and dimensionally identical to fluke 13. Therefore, reference will hereinafter be made to corresponding structural elements designated by the references numerals shown in FIGS. 1–8 and discussed in detail above. It should be understood, however, that blade portion 110 may take on configurations different from that of fluke 13.

Arm 112 extends vertically from blade portion 110 in a direction substantially perpendicular to bottom plate 37 of blade portion 110 and is generally L-shaped. The end of arm 112 opposite the end attached to blade portion 110 defines a convex end surface 113. Arm 112 also defines two connection holes 114, 116. Preferably, connection holes 114, 116 are thru-holes. Hole 114 serves as an eye for attachment of a trip line (not shown) to pull anchor 100 in a backward direction for easy break-out when weighing anchor. Hole 116 serves as a connection location for pinning anchor 100 to a bow roller bracket attached to the boat for storage of anchor 100 when not in use.

Arm 112 also defines an opening 118 having a center 119. Preferably, opening 118 is a thru-opening. As will be discussed more fully below, opening 118 serves as the pivotal point of connection between fluke 102 and shank 104. Disposed on either side of opening 118 are elongated slots 120, 122. Preferably, slots 120, 122 are thru-slots. Both of slots 120, 122 define an arcuate path along their length and have a radius of curvature generally centered about center 119 of opening 118. Preferably, but not necessarily, slots 120, 122 have substantially the same radius of curvature. Slot 120 has a first end 120*a* and an opposing second end 120*b*. Likewise, slot 122 has a first end 122*a* and an opposing second end 122*b*. The overall length of slot 120 is greater than the overall length of slot 122, the reason for which will become apparent. As will also be discussed more fully below, one or both of slots 120, 122 serve to limit the pivotal movement of fluke 102 relative to shank 104 within a range of motion.

Figure 15:
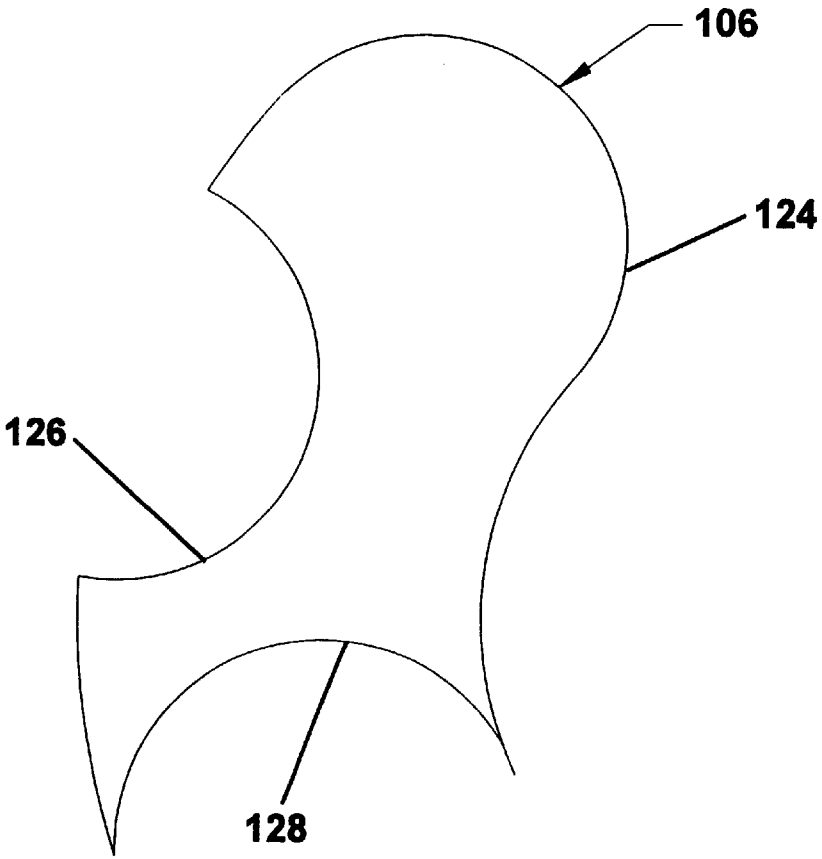
FIG. 15 is a side elevation view of a pivot restraint member used with the anchor shown in FIG. 10.

Referring to FIG. 15, shown therein is the structural configuration of pivot control member 106. Pivot control member 106 has a shape which generally corresponds to slot 120 and has a length approximately 2/3 the length of slot 120. Specifically, pivot control member 106 has a curved outer surface 124, generally corresponding to the curved inner surface of slot 120, whereby pivot control member 106 may be snuggly fit within slot 120. Outer surface 124 is interrupted by two half-moon shaped curved recesses 126, 128. Pivot control member 106 is preferably composed of an elastomeric material, such as urethane. Alternatively, pivot control member 106 can be formed of any material which can be relatively easily elastically deformed, such as, for example, rubber or certain plastic materials. Additionally, pivot control member 106 is preferably composed of a material resistant to corrosion associated with the marine environment, such as the corrosive effect of salt water.

Figure 17:
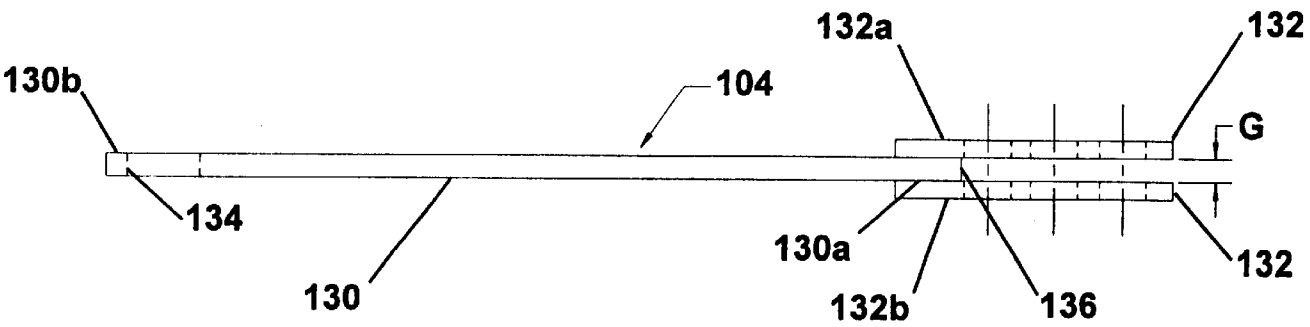
FIG. 17 is a top plan view of the shank shown in FIG. 16.
Figure 16:
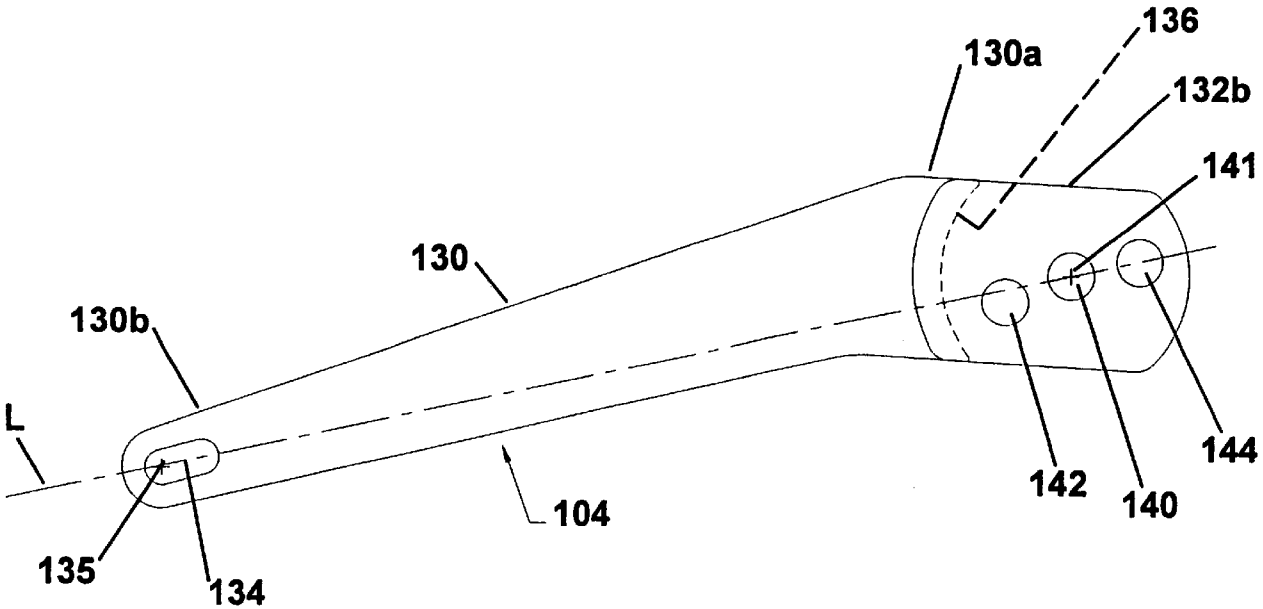
FIG. 16 is a side elevation view of a shank used with the anchor shown in FIG. 10.

Referring to FIGS. 16–17, shown therein are various structural details of shank 104. Shank 104 includes an elongated portion 130 and a yoke portion 132, both of which are preferably formed of ⅜ inch thick stainless steel plate. Elongated portion 130 has a proximal portion 130*a* and a distal portion 130*b*. Distal portion 130*b* defines an oblong eyelet 134 for attachment to a main anchor line 133, which extends to and is securely attached to the boat. The terminal end of anchor line 133 attached to distal portion 130*b* is preferably sized so that it may freely slide within eyelet 134. However, when anchor 100 is being pulled by anchor line 133, elongated portion 130 is attached to anchor line 133 at connection point 135, the distal end of eyelet 134. Proximal portion 130*a* defines a concave end surface 136 which is substantially complementary to convex end surface 113 of arm 112.

Yoke portion 132 comprises two parallel yoke plates 132*a*, 132*b* securely attached to opposite sides of elongated portion 130, preferably by welding. Yoke plates 132*a*, 132*b* are thus separated by a gap G which is equal to the thickness of elongated portion 130. Gap G is slightly greater than the thickness of arm 112 so that arm 112 may be slidably received between yoke plates 132*a*, 132*b*. Yoke portion 132 defines three parallel openings 140, 142, 144 extending through yoke plates 132*a*, 132*b*. Opening 140 has a center 141 and a diameter generally equal to the diameter of opening 118 in arm 112. Openings 142, 144 are disposed on either side of opening 140 and are respectively aligned with slots 120, 122 when center 141 of opening 140 is aligned with center 119 of opening 118. Preferably, the diameters of openings 142, 144 are substantially equal to the respective widths of slots 120, 122. Shank portion 104 also defines a longitudinal axis L passing between center 141 of opening 140 and point of connection 135.

Figure 12:
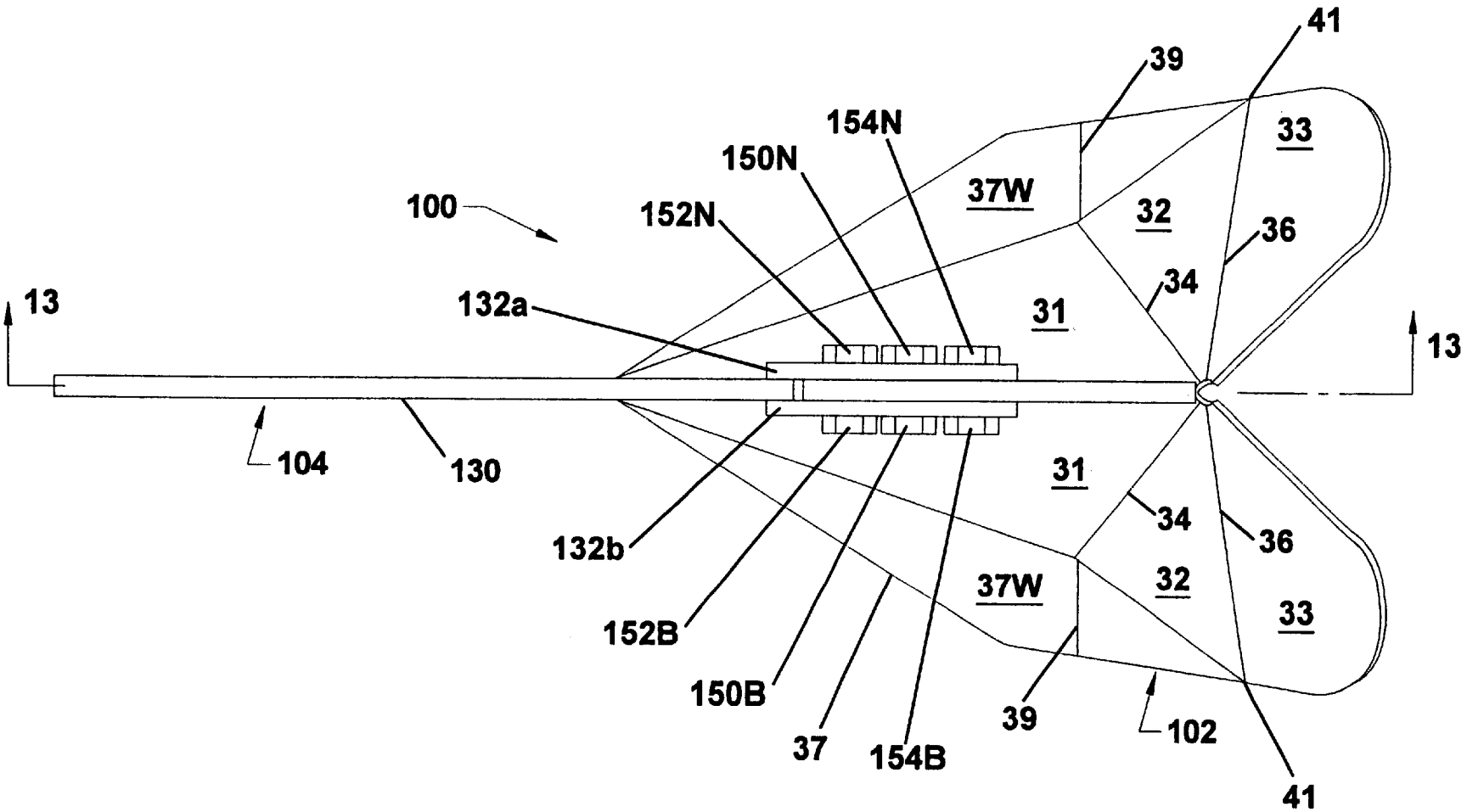
FIG. 12 is a top plan view of the anchor shown in FIG. 10.
Figure 13:
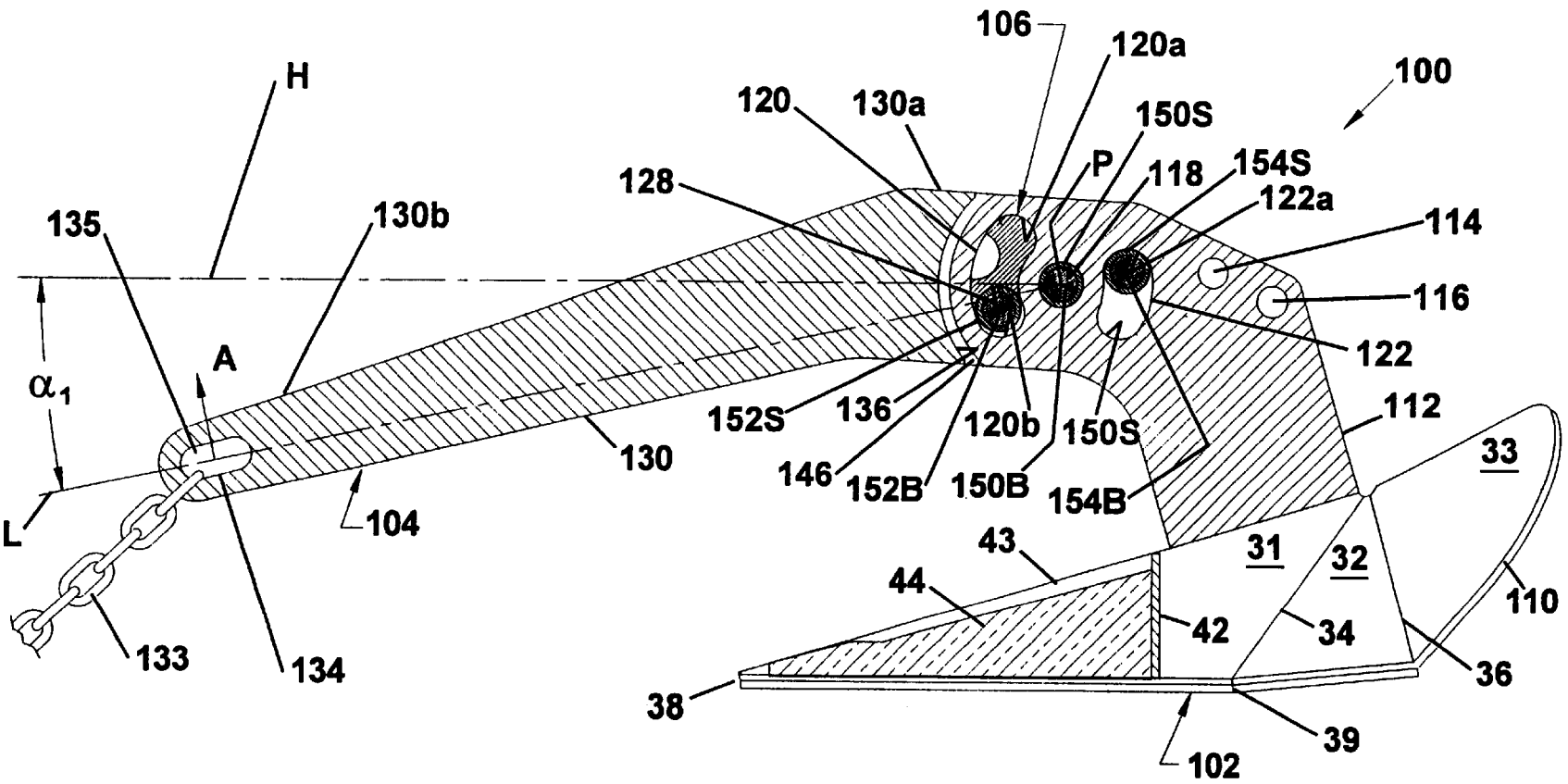
FIG. 13 is a partial sectional view of the anchor shown in FIG. 10 taken along line 13—13 of FIG. 12, illustrating a first operational position of the anchor.

Referring once again to FIGS. 10–13, illustrated therein is assembled anchor 100. The assembly of anchor 100 is accomplished by first positioning pivot control member 106 within slot 120, as shown in FIG. 13. Next, yoke plates 132*a*, 132*b* are positioned about arm 112. In other words, arm 112 is slidably received within gap G between yoke plates 132*a*, 132*b*. Opening 140 of yoke portion 132 is aligned with opening 118 of arm 112 so that their respective centers 141, 119 are generally concentric. A pin is then inserted through openings 140, 118 to thereby pivotally connect fluke 102 to shank 104. The pin defines a pivot axis P, about which fluke 102 and shank 104 may be pivoted relative to one another. Pivot axis P is preferably contained in a horizontal plane H (FIG. 13). In other words, pivot axis P is preferably aligned in a generally horizontal configuration. However, it should be understood that pivot axis P can alternatively be aligned in other configurations as well, such as, for example, an angled configuration or a vertical configuration. As shown in FIG. 12, fluke 102 is generally symmetrical with respect to plane 13—13. Preferably, pivot axis P is aligned perpendicular to plane of symmetry 13—13. However, fluke 102 need not necessarily have a symmetrical configuration. Moreover, pivot axis P can alternatively be aligned at a non-perpendicular angle relative to plane of symmetry 13—13.

Once shank 104 is pivotally connected to arm 112, as most clearly shown in FIG. 13, convex end surface 113 of arm 112 is positioned in close proximity to concave end surface 136 of elongated portion 130. Convex end surface 113 is separated from concave end surface 136 by a gap 146. Gap 146 is preferably minimized in order to prevent dirt, sand, mud or other underwater debris from entering gap 146 and negatively affecting the operation of anchor 100. For instance, if debris displaced by blade portion 110 enters gap 146, the debris may become lodged between surfaces 113, 136 and impede the pivotal movement of shank 104 relative to fluke 102.

In a preferred embodiment, the pivot pin is comprised of a bolt 150B and a sleeve 150S positioned about a portion of the shank of bolt 150B. A purpose of sleeve 150S is to prevent the threads of bolt 150B from mauling the inside surfaces of openings 140, 118 and to provide additional strength and rigidity to bolt 150B, which may be subjected to substantial shear stresses during the use of anchor 100. Lock nut 150N is threaded onto the threaded shank of bolt 150B to maintain bolt 150B and sleeve 150C in position. A locking device, such as a lock washer (not shown), may be positioned between nut 150N and yoke plate 132*a* to prevent nut 150N from loosening. If sleeve 150S is configured to have a length approximately equal to the overall width of yoke portion 132, an additional purpose of sleeve 150S is to prevent overtightening of nut 150N onto bolt 150B from potentially pinching yoke plates 132*a*, 132*b* tightly against arm 112, thus inhibiting or preventing the desired pivotal movement of anchor 100.

It should be understood that the pin which pivotally connects fluke 102 to shank 104 can take on alternative configurations other than the bolt/sleeve/nut combination described above. For instance, a pin may be operably connected to one or both of yoke plates 132*a*, 132*b* by any method known to one of ordinary skill in the art, such as by welding, or the pin may be integrally machined in either of yoke plates 132*a*, 132*b*. The pin may then be received in opening 118 to provide pivotal movement between fluke 102 and shank 104. Additionally, it should be understood that either or both of yoke plates 132*a*, 132*b* are not necessarily required to pivotally connect fluke 102 and shank 104. For instance, proximal portion 130*a* of elongated portion 130 may be pivotally connected directly to arm 112. Moreover, yoke plates 132*a*, 132*b* may alternatively be welded to arm 112 instead of elongated portion 130 of shank 104. In this alternative configuration, opening 118 and slots 120, 122 would be defined in proximal portion 30*a* of shank 104 instead of arm 112.

Once fluke 102 is pivotally connected to shank 104, opening 142 is aligned with slot 120 and an engaging member is inserted therethrough. The engaging member is positioned between curved recess 128 of pivot control member 106 and end 120*b* of slot 120 and is operably connected to yoke portion 132. In a preferred embodiment, the engaging member comprises a bolt 152B and a sleeve 152S positioned about a portion of the threaded shank of bolt 152B. The purpose of sleeve 152S is similar to that of sleeve 150S. Lock nut 152N is threaded onto the threaded shank of bolt 152B to thereby operably connect the bolt/sleeve combination to yoke portion 132. However, it should be understood that the engaging member may be operably connected to one or both of yoke plates 132*a*, 132*b* by any method known to one of ordinary skill in the art. A lock washer (not shown) may also be positioned between nut 152N and yoke plate 132*a* to prevent nut 152N from loosening.

Referring specifically to FIG. 13, as shank 104 is pivoted relative to fluke 102 about axis P in the direction of arrow A, sleeve 152S will bear against curved recess 128 of pivot control member 106. As shank 104 continues to be pivoted in the direction of arrow A, bolt 152B and sleeve 152S will be transferred along the length of slot 120 and will compress pivot control member 106 tightly against end 120*a* of slot 120. In turn, due to the elastic and resilient characteristics of pivot control member 106, pivot control member 106 exerts a biasing force against sleeve 152S. This force works in opposition to the pivotal movement of shank 104 in the direction of arrow A. Thus, pivot control member 106 serves to regulate or control the pivotal movement of shank 104 relative to fluke 102. In other words, bolt 152B and sleeve 152S are prohibited from traveling freely along the entire length of slot 120. Instead, their travel is inhibited/restricted by first control member 106 throughout at least a portion of the pivotal range of motion of shank 104 relative to fluke 102. The pivotal range of motion of shank 104 relative to fluke 102 is directly limited by end 120*b* of slot 120, and indirectly limited by end 120*a* via pivot control member 106.

Figure 18:
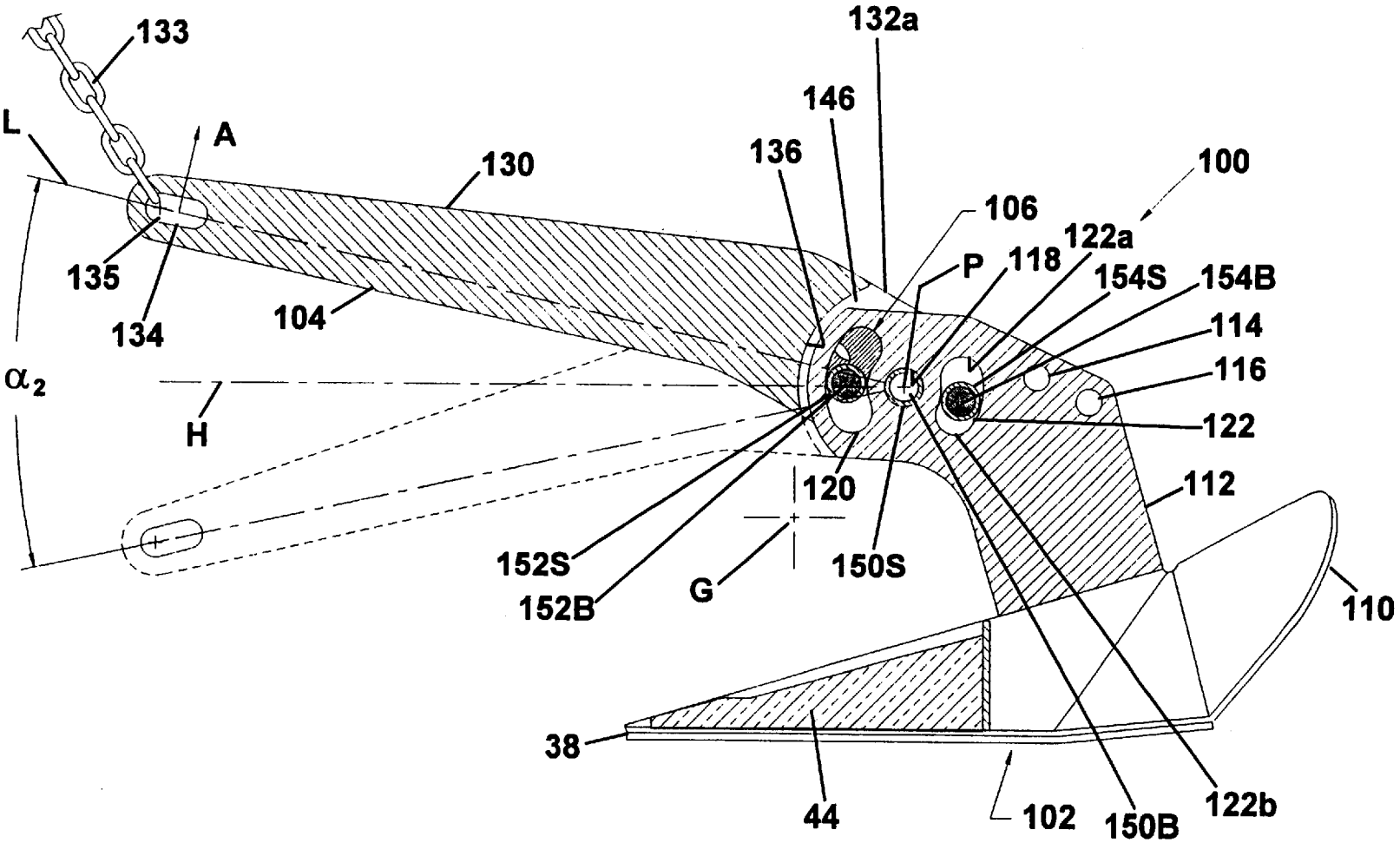
FIG. 18 is a partial sectional view of the anchor shown in FIG. 10, illustrating a second operational position of the anchor with the shank tilted upward.

Referring now to FIG. 18, as shank 104 continues to be pivoted in the direction of arrow A, pivot control member 106 is further compressed. In addition to compression of the material of pivot control member 106, curved recess 126 allows bolt 152B to travel along a greater path length of slot 120 than would otherwise be possible, by allowing pivot control member 106 to be reformed into a tighter, denser configuration. Accordingly, shank 104 may be pivoted within a greater range of motion relative to fluke 102.

It should be understood by a person of ordinary skill in the art that, by changing the material composition of pivot control member 106 or varying its shape or configuration, the pivotal movement of shank 104 relative to fluke 102 may be regulated or controlled to a greater or lesser extent. It should also be understood that pivot control member 106 need not necessarily regulate or control pivotal movement in a linear manner, but may be configured to provide variable regulation of pivotal movement. For instance, as shank 104 is pivoted in the direction of arrow A, the opposing force exerted by pivot control member 106 onto sleeve 152S may be proportionally increased. Thus, by simply altering the configuration of pivot control member 106, regulation of the pivotal movement of shank 104 relative to fluke 102 can be adjusted to meet the requirements of the particular application or use of anchor 100.

Once the force imparted by pivot control member 106 onto sleeve 152S is equal to the opposing torque exerted on shank 104, shank 104 will no longer pivot relative to fluke 102. Thus, the pivotal movement of anchor 100 is restrained within a range of motion. The extent of this range of motion is dependent on the configuration/composition of pivot control member 106, as well as the degree of torque exerted on shank 104. Consequently, the pivotal range of motion between shank 104 relative to fluke 102 is not predetermined, but is instead dependent upon the structural and elastic characteristics of pivot control member 106 and the amount of force imparted to anchor 100 by anchor line 133. Additionally, it should be understood that when the force exerted on shank 104 in the direction of arrow A is removed, the resilient/elastic characteristics of pivot control member 106 will return shank 104 to its original position, as shown in FIG. 13.

Although FIGS. 13 and 18 illustrate pivot control member 106 as regulating the pivotal movement of anchor 100 substantially throughout the entire range of motion of shank 104 relative to fluke 102, it should be understood that pivot control member 106 may regulate the pivotal movement throughout only a portion of the range of motion. For example, the length of pivot control member 106 may be shortened, thus allowing bolt 152B and sleeve 152S to travel freely and uninhibited along a portion of slot 120 until sleeve 152S contacts curved recess 128 of pivot control member 106. In other words, pivot control member 106 may be configured so that anchor 100 has both an unregulated range of motion in which shank 104 may freely pivot relative to fluke 102, and a regulated range of motion in which pivotal movement is inhibited by pivot control member 106.

In a less likely arrangement, where control is obtained by stretching a control member, pivot control member 106 may be positioned between sleeve 152S and end 120*b* of slot 120. In this configuration, curved recess 128 is operably attached, by adhesive, for example, to sleeve 152S and the opposite end of pivot control member 106 is operably attached to end 120*b* of slot 120. Therefore, instead of compressing pivot control member 106 when shank 104 is pivoted in the direction of arrow A, pivot control member 106 will be elastically stretched. The elastic stretching of pivot control member 106 will thus regulate or control the pivotal movement of shank 104 relative to fluke 102. It should additionally be understood that pivot control member 106 need not necessarily be compressed within slot 120 by bolt 152B and sleeve 152S.

It should further be understood that pivot control member 106 need not necessarily be composed of an elastomeric material. For example, pivot control member 106 could alternatively be a spring, such as a coil spring, positioned within slot 120 between sleeve 152S and either end of slot 120. Likewise, the coil spring could be operably engaged between elongate portion 130 of shank 104 and blade portion 110 of fluke 102. Pivot control member 106 can alternatively take on other configurations as would occur to one of ordinary skill in the art which would provide regulation of the pivotal movement of anchor 100. For example, pivot control member 106 could be a torsion bar, a cam mechanism or any other biasing mechanism capable of regulating linear movement.

Referring once again to FIGS. 10–13, opening 144 of yoke portion 132 is aligned with slot 122 and bolt 154B, along with sleeve 154S, are inserted therethrough. Locknut 154N is threaded onto the shank of bolt 154B to maintain bolt 154B and sleeve 154S in position. Likewise, a lock washer (not shown) may be positioned between nut 154N and yoke plate 132*a* to prevent nut 154N from loosening. Bolt 154B and sleeve 154S cooperate with slot 122 to restrain the pivotal movement of anchor 100 within a predetermined range of motion. As shank 104 is pivoted relative to fluke 102, bolt 154B will travel along the length of slot 122 between end 122*a* and end 122*b*. Thus, the range of pivotal movement of shank 104 relative to fluke 102 is positively limited by the overall length of slot 122. Therefore, unlike the extent of pivotal movement allowable by slot 120, which is dependent upon the composition/configuration of pivot control member 106 and the force exerted by anchor line 133 on shank 104, the pivotal movement allowable by slot 122 is limited within a predetermined range of motion by ends 122*a*, 122*b*. In other words, the locations of ends 122*a*, 122*b* of slot 122 determine the outer limits of the pivotal range of motion of shank 104 relative to fluke 102. Preferably, slot 122 is configured such that as shank 104 is pivoted in the direction of arrow A, sleeve 154S will come into contact with end 122*b* of slot 122 prior to sleeve 152S coming into close proximity with end 120*a* of slot 120. In this manner, sleeve 152S will not overly compress pivot control member 106 beyond its elastic limits, or otherwise jeopardize the structural integrity of pivot control member 106. In a preferred embodiment, the length of slot 122 is such that the predetermined range of motion of shank 104 relative to fluke 102 is in a range of about 10 degrees to about 25 degrees.

Reference will now be made to the operational characteristics of anchor 100. Preferably, anchor line 133 used to connect anchor 100 to the boat is a chain. A chain is rugged enough to avoid being cut or damaged by underwater obstructions such as sharp rocks, coral or the like. However, other types of anchor lines may also be used, including steel cable or natural/synthetic fiber rope. Initially, anchor 100 is dropped from the boat in a conventional manner. Anchor 100 has a buoyant center of gravity G (FIG. 18) which is at least partially determinative of the manner in which it will descend toward the bottom of the lake, river, sea or body of water (hereinafter "the bottom"). The speed of the boat and the weight of the anchor line will also affect the angle of descent of the anchor. The center of gravity G can be varied by simply replacing ballast 44 with a heavier or lighter ballast, or by using a ballast material having a different density. Preferably, anchor 100 will land on the bottom in a substantially upright position, as shown in FIG. 13. However, as with all anchors, in some instances anchor 100 will land on its side and/or shank 104 may end up facing a direction non-parallel to the line of pull.

In the case of conventional anchors landing on their side, most will remain on their side and will not straighten up to an upright position, thus making them difficult (if not impossible) to set. Furthermore, in cases where conventional anchors land in an orientation where the shank is aligned non-parallel to the line of pull, the anchors tend to tip on their sides, thus presenting the same problem described immediately above. Moreover, even if the shank is generally aligned with the line of pull, conventional anchors typically have a relatively high center of gravity and, when pulled by the anchor line, similarly tend to tip sideways. If the anchor line is a chain, the added weight of the chain greatly promotes the tendency of conventional anchors to tip on their sides.

Shank 104 of anchor 100 is initially angled downward toward the bottom (i.e., toward blade portion 110 of fluke 102). If anchor 100 lands on its side or if shank 104 is not aligned in the direction of the line of pull, when pulled by anchor line 133, anchor 100 will automatically turn and assume the preferred, upright/aligned configuration for optimal setting. This desirable characteristic of anchor 100 is at least partially due to the angular orientation of shank 104 relative to horizontal axis H, as well as the particular shape and configuration of fluke 102. Additionally, because shank 104 is angled downward, the point (or locus) of connection 135 to anchor line 133 is in relative close proximity to the bottom. The weight of the chain pulling downward on shank 104 is therefore minimized. This, coupled with the relative low center of gravity G and the shape/configuration of fluke 102, greatly reduces the tendency of anchor 100 to tip on its side. Thus, anchor 100 is capable of orienting itself into a desired position for optimal setting, and maintaining this position by offering resistance to the tendency to tip sideways. As a result, anchor 100 may be securely imbedded into the bottom.

As shown in FIG. 13, anchor 100 is capable of assuming an operational position in which the point of connection 135 is positioned below horizontal plane H. More specifically, longitudinal axis L of shank 104 defines an acute angle $\alpha_1$ relative to horizontal plane H. Preferably, but not necessarily, acute angle $\alpha_1$ is at least 10°. Ideally, point of connection 135 is positioned as close to the bottom as possible, so long as distal portion 130*b* of shank 104 does not itself become imbedded in the bottom. In a preferred embodiment, anchor 100 is capable of assuming an operational position in which point of connection 135 is positioned below center of gravity G (as shown in FIG. 18). This further aids in reducing the tendency of anchor 100 to tip sideways.

Once anchor 100 is properly oriented in the direction of the line of pull, the force exerted by anchor line 133 on shank 104 will tend to facilitate the downward tipping of fluke 102, thus allowing point 38 to penetrate or dig into the bottom. This tendency is at least partially due to the alignment of shank 104 at angle $\alpha_1$, as well as the forward location of center of gravity G of anchor 100. Notably, the shanks of conventional anchors are either aligned in a substantially horizontal configuration or are angled upward, away from the bottom. Thus, with conventional anchor designs, the pull of the anchor line actually tends to work against proper setting of the anchor, particularly if the direction of the line of pull forms a steep angle relative to a horizontal plane.

In order to prevent shank 104 from immediately rising up in response to the force exerted by anchor line 133 on shank 104, pivot control member 106 regulates the pivotal movement of shank 104 relative to fluke 102. Thus, point 38 is allowed to initially penetrate the bottom prior to the pivoting of shank 104 in the direction of arrow A. Without pivot control member 106, anchor 100 would potentially suffer from the same drawbacks associated with conventional anchor designs (e.g., improper setting and the increased tendency to tip sideways).

Turning now to FIG. 18, once point 38 of fluke 102 is initially imbedded in the bottom, shank 104 will begin to pivot about pivot axis P in the direction of arrow A until reaching a final operational position. This final operational position is reached when the force exerted by pivot control member 106 onto sleeve 152S is equivalent to the torque exerted on shank 104, or when sleeve 154S comes into bearing contact with end 122*b* of slot 122, whichever occurs first. Preferably, the range of motion $\alpha_2$ between the original operational position (shown in dashed lines) and the final operational position (shown in solid lines) is between the range of about 10 degrees to about 25 degrees. However, it should be understood that anchor 100 may be configured to provide a greater range of motion $\alpha_2$ by simply increasing the path length of either or both of slots 120, 122.

Because pivot control member 106 regulates the pivotal movement of anchor 100, fluke 102 will gradually become imbedded in the bottom in response to shank 104 being pulled by anchor line 133. Importantly, pivot control member 106 prevents fluke 102 from immediately diving into the bottom at a steep angle of inclination, which may potentially cause tip 38 to be dislodged and/or affect the proper setting of anchor 100. Regulation of the pivotal movement of anchor 100 thus ensures that anchor 100 will become securely imbedded in the bottom.

To better illustrate the constructural configuration of pivot control member 106, the dimensions of one manufactured embodiment are hereafter listed. It should be understood, however, that these dimensions are exemplary and are not intended to limit the scope of protection sought. The use of dimensions other than those listed are contemplated as within the scope of the invention.

Referring to FIG. 15, shown therein is pivot control member 106 configured for insertion within slot 120 of arm 112. The body of pivot control member 106 is generally arcuate along its length and has an inner radius of approximately 0.96 inches and an outer radius of approximately 2.05 inches. Thus, the overall width is approximately 1.09 inches. One end of pivot control member 106 defines a convex surface having an outer radius of approximately 0.54 inches, while the opposing end defines concave curved recess 128 having an inner radius of approximately 0.56 inches. Pivot control member 106 also defines concave curved recess 126 generally centered along the length of pivot control member 106, extending from the surface defining the outer radius. Curved recess 126 is substantially semi-circular and has a radius of approximately 0.50 inches. The thickness of pivot control member 106 is approximately 0.50 inches. It should be understood that the precise structural and dimensional configuration of pivot control member 106 may be varied to provide the necessary regulation of pivotal movement to meet the requirements of the particular application or use of anchor 100. As mentioned above, the foregoing structural and dimensional details in no way limit the scope of protection sought, and other configurations are contemplated as would occur to one of ordinary skill in the art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An anchor for a marine vessel for anchoring to the bottom of a body of water, comprising:

a fluke portion;

a shank portion pivotally connected to said fluke portion to allow pivotal movement therebetween about a pivot axis; and a pivot control member engageable between said fluke portion and said shank portion to regulate said pivotal movement throughout a range of motion during penetration of said fluke portion into the bottom.

2. The anchor of claim 1, wherein said pivot control member is elastically deformed throughout said range of motion.

3. The anchor of claim 1, wherein said pivot control member provides variable regulation of said pivotal movement throughout said range of motion.

4. The anchor of claim 1, wherein:

one of said fluke and shank portions defines a slot and said pivot control member is positioned within said slot;

an engaging member is operably connected to a corresponding one of said fluke and shank portions and is positioned in said slot adjacent said pivot control member;

said pivot control member exerts a biasing force on said engaging member to regulate said pivotal movement throughout said range of motion.

5. The anchor of claim 1, wherein said pivot control member is composed of an elastomeric material.

6. The anchor of claim 5, wherein said pivot control member is composed of a urethane.

7. The anchor of claim 1, wherein said pivot axis is contained in a horizontal plane.

8. The anchor of claim 7, wherein said shank portion is connected to an anchor line at a locus of connection, said anchor including an operational position during penetration of said fluke portion into the bottom in which said locus of connection is positioned below said horizontal plane.

9. The anchor of claim 8, wherein said shank portion defines a longitudinal axis between said pivot axis and said locus of connection, said operational position defines an acute angle between said horizontal plane and said longitudinal axis.

10. The anchor of claim 9, wherein said acute angle is at least 10 degrees.

11. The anchor of claim 8, wherein said anchor has a center of gravity, and wherein said operational position places said locus of connection below said center of gravity.

12. The anchor of claim 4, wherein said pivot control member is elastically compressed between said engaging member and an end of said slot as said shank portion is pivoted about said pivot axis relative to said fluke portion throughout said range of motion.

13. An anchor for a marine vessel for anchoring to the bottom of a body of water, comprising:

a shank portion;

a fluke portion;

a pin defining a pivot axis, said pin pivotally connecting said shank portion to said fluke portion;

a pivot restraint defined by said fluke portion and said shank portion to operably limit pivotal movement therebetween within a range of motion; and a biasing member engageable between said fluke portion and said shank portion to provide a force for controlling said pivotal movement throughout at least a portion of said range of motion during penetration of said fluke portion into the bottom.

14. The anchor of claim 13, wherein said fluke portion has a plane of symmetry, said pivot axis is perpendicular to said plane of symmetry.

15. The anchor of claim 14, wherein one of said shank portion and fluke portion defines an opening, said pin is operably connected to a corresponding one of said shank portion and said fluke portion and is received in said opening to provide said pivotal movement.

16. An anchor for a marine vessel, comprising:

a shank portion;

a fluke portion;

a pin defining a pivot axis, said pin pivotally connecting said shank portion to said fluke portion;

a pivot restraint, comprising;

a slot defined in one of said fluke and shank portions;

an engaging member operably connected to a corresponding one of said fluke and shank portions and received in said slot;

said engaging member adjustably positioned along a length of said slot as said shank portion is pivoted about said pivot axis relative to said fluke portion; and said slot having a first end and an opposite second end which operably limit pivotal movement of said shank portion relative to said fluke portion within a range of motion; and a biasing member engageable between said fluke portion and said shank portion to provide a force for controlling said pivotal movement throughout at least a portion of said range of motion.

17. The anchor of claim 16, wherein said pivot restraint limits said pivotal movement within a predetermined range of motion.

18. The anchor of claim 16, wherein said biasing member is disposed within said slot between one of said first and second ends and said engaging member.

19. The anchor of claim 18, wherein said biasing member is elastically compressed between said one of said first and second ends and said engaging member as said shank portion is pivoted about said pivot axis relative to said fluke portion throughout said at least a portion of said range of motion.

20. The anchor of claim 13, wherein said biasing member is elastically deformed throughout said at least a portion of said range of motion.

21. An anchor for a marine vessel for anchoring to the bottom of a body of water, comprising:

a fluke portion;

a shank portion;

means for pivotally connecting said fluke portion to said shank portion to allow pivotal movement therebetween; and means for regulating said pivotal movement throughout a range of motion during penetration of said fluke portion into the bottom.

22. The anchor of claim 21, further comprising means for limiting said pivotal movement within a predetermined range of motion.

23. An anchor for a marine vessel, comprising:

a shank portion;

a fluke portion;

an arm portion fixed to said fluke portion at a locus of fixation;

a connector fastening said shank portion to said arm portion for pivotal movement of said shank portion relative to said fluke portion about a pivot axis;

a pivot restraint adapted to allow said shank portion to freely pivot relative to said fluke portion within a predetermined range of motion; and wherein the anchor defines a vertical plane containing said pivot axis, said pivot axis lying in a plane substantially perpendicular to said vertical plane.

24. The anchor of claim 23, further comprising a pivot control member to regulate said pivotal movement throughout at least a portion of said predetermined range of motion.

25. An anchor for a marine vessel and comprising:

a shank portion;

a fluke portion;

an arm portion fixed to the fluke portion at a locus of fixation;

a connector fastening the shank portion to the arm portion for pivotal movement of the shank portion relative to the fluke portion about a pivot axis;

a pivot restraint adapted to allow the shank portion to freely pivot relative to the fluke portion within a predetermined range of motion; and wherein the fluke portion has a plane of symmetry the pivot axis being perpendicular to the plane of symmetry.

26. The anchor of claim 25 and wherein:

the fluke portion has a cavity therein defined by a plurality of walls.

27. The anchor of claim 26 and wherein:

the fluke portion has a plane of symmetry and the cavity is bounded by triangular top and rear walls and a bottom wall.

28. The anchor of claim 26 and further comprising:

a mass in the cavity, a combination of the fluke portion, the arm portion and the mass providing a center of gravity behind a vertical plane which contains the pivot axis.

29. The anchor of claim 28 and wherein:

the center of gravity is forward of the locus of fixation of the fluke portion to the arm portion.

30. The anchor of claim 25 and wherein the fluke portion has a top and a bottom, the anchor further comprising:

a plate on the bottom of the fluke portion.

31. An anchor for a marine vessel and comprising:

a shank portion;

a fluke portion and wherein:

the fluke portion has two top panels having joined upper edges defining a top margin of the fluke portion; and the fluke portion has wings extending outward from lower edges of the top panels; and an arm portion is fixed to the fluke portion at a locus of fixation and is pivotally connected to the shank portion for pivotal movement of the shank portion relative to the fluke portion; and a pivot restraint adapted to allow the shank portion to freely pivot relative to the fluke portion within a predetermined range of motion.

32. The anchor of claim 31 and further comprising:

a bottom wall extending inward from the lower edge of each of the top panels toward the lower edge of the other top panel.

33. The anchor of claim 32 and wherein the fluke portion has a cavity therein defined by the top panels and bottom wall.

34. The anchor of claim 33 and further comprising:

a mass in the cavity and providing a center of gravity of the anchor forward of the locus of fixation of the fluke portion to the arm portion.

35. The anchor of claim 31 and wherein:

the fluke portion has a plane of symmetry and the two top panels are generally triangular, the anchor further comprising:

an additional generally triangular panel at a rear edge of each of the top panels, the additional panels flaring outwardly and having a lower edge defining a rear margin of each of the wings; and an irregular panel at a rear edge of each of the additional panels and flaring generally upward and rearward from the additional panel.

36. The anchor of claim 31 and wherein:

the wings are generally co-planar and there is a hinge connecting the shank portion to the arm portion, the hinge having a pivot axis lying in a plane parallel to the plane of the wings.

37. The anchor of claim 31 wherein:

the fluke portion has a plane of symmetry and the wings are generally co-planar.

38. An anchor for a marine vessel comprising:

a shank portion;

a fluke portion connected to the shank portion and wherein:

the fluke portion has two generally triangular top panels having joined upper edges defining a top margin of the fluke portion; and the fluke portion has generally coplanar wings extending outward from lower edges of the top panels; and the fluke portion has a bottom wall extending inward from the lower edge of each of the top panels toward the lower edge of the other top panel; and the fluke portion has a cavity therein defined by the top panels and bottom wall; and the bottom wall is a plate which extends outboard of the lower edge of each of the top panels to provide the wings.

39. The anchor of claim 38 and further comprising:

an additional generally triangular panel at a rear edge of each of the top panels, the additional panels flaring outwardly and having a lower edge defining a rear margin of each of the wings.

40. The anchor of claim 39 and further comprising:

an irregular panel at a rear edge of each of the additional panels and flaring generally upward and rearward from the additional panel.

41. An anchor for a marine vessel and comprising:

a shank portion;

a fluke portion;

an arm portion fixed to the fluke portion at a locus of fixation;

a connector fastening the shank portion to the arm portion for pivotal movement of the shank portion relative to the fluke portion about a pivot axis; and a pivot restraint adapted to allow the shank portion to freely pivot relative to the fluke portion within a predetermined range of motion, the pivot restraint includes:

a first thru-hole in the shank portion;

a second thru-hole in the arm portion and aligned with the first thru-hole, one of the first and second thru-holes being an elongated slot; and a second connector received through the first and second thru-holes.

42. An anchor for a marine vessel and comprising:

a shank portion;

a fluke portion;

an arm portion fixed to the fluke portion at a locus of fixation;

a connector fastening the shank portion to the arm portion for pivotal movement of the shank portion relative to the fluke portion about a pivot axis; and a pivot restraint adapted to allow the shank portion to freely pivot relative to the fluke portion within a predetermined range of motion between 10 degrees and 25 degrees.

* * * * *